US007784149B2

(12) United States Patent
Schwarz et al.

(10) Patent No.: US 7,784,149 B2
(45) Date of Patent: Aug. 31, 2010

(54) VACUUM DUSTER

(75) Inventors: Ralph Schwarz, Racine, WI (US); Matthew Charles White, Cambridge (GB); George Richard Gregory, Royston (GB); Robin Craig Cocker, Oldham (GB); Craig F. Shiesley, Racine, WI (US); Benn Beagan Miller, Cambridge (GB)

(73) Assignee: S.C. Johnson & Son, Inc., Racine, WI (US)

( * ) Notice: Subject to any disclaimer, the term of this patent is extended or adjusted under 35 U.S.C. 154(b) by 142 days.

(21) Appl. No.: 11/873,131

(22) Filed: Oct. 16, 2007

(65) Prior Publication Data

US 2008/0086834 A1 Apr. 17, 2008

Related U.S. Application Data

(60) Provisional application No. 60/829,604, filed on Oct. 16, 2006.

(51) Int. Cl.
*A47L 5/24* (2006.01)

(52) U.S. Cl. ..... 15/344; 15/347; 15/209.1

(58) Field of Classification Search ..... 15/344, 15/347–350, 329, 380, 393, 394, 105, 234, 15/209.1

See application file for complete search history.

(56) References Cited

U.S. PATENT DOCUMENTS

| | | | | |
|---|---|---|---|---|
| 1,902,534 | A | 1/1933 | Wielatz | |
| 2,036,789 | A | 4/1935 | Baker | |
| 2,255,271 | A * | 9/1941 | Rast | 15/395 |
| 2,671,926 | A * | 3/1954 | Minerley | 15/387 |
| 3,721,502 | A | 3/1973 | Ognibene | |
| 4,956,892 | A | 9/1990 | Fawkes | |
| 4,972,541 | A | 11/1990 | Smith, Jr. | |
| 5,399,381 | A | 3/1995 | Randall | |
| 5,432,976 | A | 7/1995 | Alazet | |
| 5,590,439 | A | 1/1997 | Alazet | |
| 5,603,139 | A | 2/1997 | Alazet | |
| 5,692,263 | A | 12/1997 | Sorenson | |

(Continued)

FOREIGN PATENT DOCUMENTS

| | | |
|---|---|---|
| DE | 129412 | 4/1902 |

(Continued)

OTHER PUBLICATIONS

PCT/US2007/022000 International Search Report & Written Opinion dated Apr. 21, 2008.

*Primary Examiner*—Dung Van Nguyen

(57) ABSTRACT

Handheld dust removal devices that selectively utilize vacuum pressure are disclosed. Preferably each device includes a small lightweight handle that houses a vacuum assembly having an electric motor and a battery. The device further includes a duster assembly for removably holding a dusting cloth or cover, whereby it can be used similarly to a conventional duster. The vacuum source can be fluidly connected to and draw a vacuum airflow through the duster assembly, for example, through and/or around the dusting cloth. In some implementations, this is done by drawing the vacuum airflow toward opposing lateral portions of the duster assembly. Some implementations further include an auxiliary vacuum inlet that is adapted and configured for drawing large particles such as crumbs, hair, and others thereinto. The auxiliary vacuum port can be displaced from the duster assembly, e.g., mounted to the handle or elsewhere, as desired.

16 Claims, 7 Drawing Sheets

U.S. PATENT DOCUMENTS

| | | | | |
|---|---|---|---|---|
| 5,720,078 | A | 2/1998 | Heintz | |
| 5,909,755 | A | 6/1999 | Leal | |
| 6,101,671 | A | 8/2000 | Wright et al. | |
| 6,370,731 | B1 | 4/2002 | Carter | |
| 6,746,166 | B1 | 6/2004 | Jeon et al. | |
| 6,799,350 | B1 * | 10/2004 | Gordon | 15/344 |
| 6,921,438 | B2 | 7/2005 | Lausevic | |
| 7,251,857 | B2 * | 8/2007 | Caruso | 15/377 |
| 2004/0025271 | A1 | 2/2004 | Shimada et al. | |
| 2004/0148732 | A1 | 8/2004 | Allard-Latour et al. | |
| 2004/0154125 | A1 | 8/2004 | Houvener | |
| 2004/0221419 | A1 | 11/2004 | Francoeur | |
| 2005/0015919 | A1 | 1/2005 | Stewart | |
| 2006/0048331 | A1 | 3/2006 | Rau et al. | |
| 2006/0185108 | A1 | 8/2006 | Hoadley et al. | |
| 2006/0213025 | A1 | 9/2006 | Sawalski | |

FOREIGN PATENT DOCUMENTS

| | | | |
|---|---|---|---|
| DE | 393045 | | 3/1924 |
| DE | 1863708 | | 12/1962 |
| DE | 1729760 | | 2/1972 |
| DE | 7338241 | | 6/1974 |
| DE | 7404554 | | 1/1975 |
| DE | 3528340 | | 2/1987 |
| DE | 3831953 | | 3/1990 |
| DE | 9011578 | | 12/1990 |
| DE | 9206415 | | 10/1992 |
| DE | 29612498 | | 10/1996 |
| DE | 19749098 | | 8/1998 |
| DE | 19800059 | | 7/1999 |
| DE | 19857685 | | 6/2000 |
| DE | 20008022 | | 9/2000 |
| DE | 353491 | | 7/2004 |
| WO | WO2005084510 | A1 | 9/2005 |

* cited by examiner

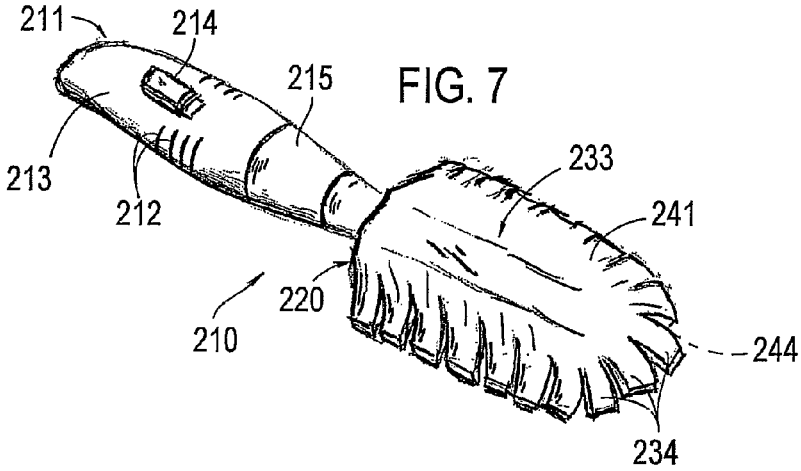
FIG. 7
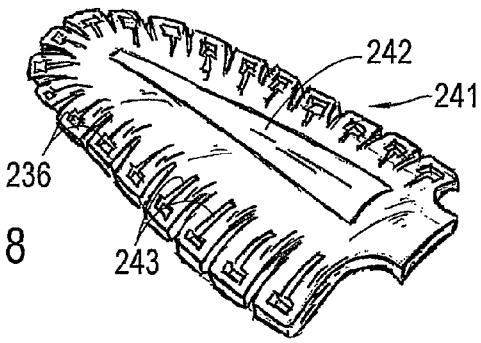
FIG. 8
FIG. 9
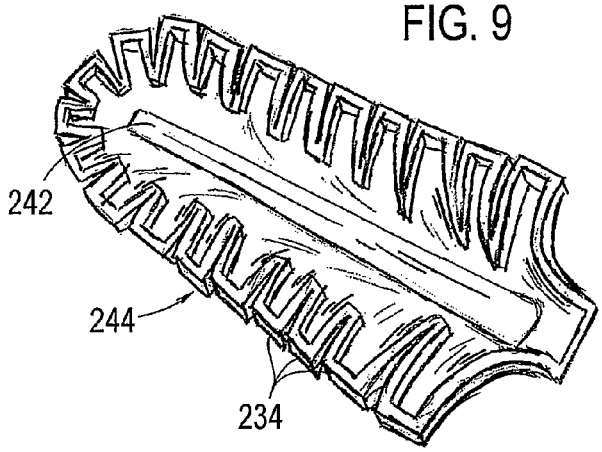

VACUUM DUSTER

CROSS-REFERENCE TO RELATED APPLICATIONS

This application claims priority from U.S. Provisional Patent Application Ser. No. 60/829,604, filed on Oct. 16, 2006, the entirety of which is expressly incorporated herein by reference.

BACKGROUND OF THE INVENTION

1. Field of the Invention

The present invention relates to cleaning and dusting devices in general. More particularly, it relates to cleaning and dusting devices having a replaceable cleaning implement and a vacuum integrated into a handle for enhancing various dust removal or cleaning characteristics of the cleaning implement.

2. Discussion of the Related Art

Numerous attempts have been made to incorporate vacuum or suction-type features into various cleaning tools and devices. The below-referenced U.S. patents and published U.S. applications disclose embodiments that were at least in-part satisfactory for the purposes for which they were intended. The disclosures of all the below-referenced prior United States patents and applications, in their entireties, are hereby expressly incorporated by reference into the present application for purposes including, but not limited to, indicating the background of the present invention and illustrating the state of the art.

U.S. Pat. No. 4,956,892 to Fawkes discloses a cordless vacuum brush. The vacuum brush includes a vacuum assembly containing a motor, fan, dust trap, and an elongated hollow handle assembly containing a plurality of battery cells connected in series for operating the motor. The handle assembly is detachably secured to the vacuum assembly. A generally rectangular flat elongated brush head with a hollow interior and peripheral pliable bristles is attached to the vacuum assembly. The head is flexible and moveable in relation to the vacuum assembly.

U.S. Pat. No. 4,972,541 to Smith, Jr. discloses a feather duster with a fan assembly/dust catching assembly. The dust catching system traps the dust stirred up by the feathers of the feather duster. The dust-catching system includes a fan unit which co-operates with a dust-catching element via a bell-shaped conduit. A skirt assembly is configured to move dust from the feather section to the dust-catching element. In one embodiment, the skirt assembly includes a turbulence-inducing area in which the dust-laden air is thoroughly mixed so the dust does not tend to settle out of the air before that air can be moved into the dust catching system.

U.S. Pat. No. 5,399,381 discloses a protective cover for electric brooms. The flexible fabric covering is intended to be placed over the head of a conventional electric broom. The application notes that the covering is preferably composed of a terrycloth-type material. The suction head of an electric broom is inserted into the first opening and a second opening is aligned with the suction opening formed through the floor-contacting surface of the electric broom.

U.S. Pat. No. 5,432,976 to Alazet discloses a device for collecting refuse and dust. The device includes an elongate body configured to carry a set of bristles. The body is hollow so as to contain, in its interior, a chamber for receiving refuse and dust. The refuse and dust are driven through a mouthpiece of an orifice via a vertical conduit, then through a channel into the receiving chamber. The vacuum and the suction are created by a suction turbine driven by an electric motor supplied by rechargeable electric batteries.

U.S. Pat. No. 5,720,078 to Heintz relates to a suction device for removing liquids from a surface. The device includes an air chamber formed from a top and a bottom plate. The air chamber is in fluid communication with a fitting adjacent thereto. The bottom plate includes a plurality of holes therethrough and a fabric adjacent thereto.

U.S. Pat. No. 5,909,755 to Leal discloses a vacuum dust mop to be used on furnishings, floors, and walls. The apparatus consists of a housing having suction slots on four sides and the bottom. A motor device sits within the housing and creates a vacuum which draws dust into the slots. A filter mechanism within the housing traps the dust for subsequent removal from the housing. The housing is covered by a soft cloth cover so as not to scratch the surfaces to be cleaned. The cover has a plurality of holes on the side and bottom in order to allow the dust particles to access the suction slots and an internally sewed glove to allow the unit to be hand held. An appenditure on the top of the housing has internal threads in order to accept a broom handle to allow the unit to be easily used on floors and walls.

U.S. Pat. No. 6,101,671 to Wright et al. discloses a self-contained mopping and drying system for floors that includes a housing, a handle extending from the housing, and a scrubbing member mounted on the housing. A pair of squeegees is mounted on the housing for collecting contaminated liquid on a floor surface, and a suction system is within the housing for removing the contaminated liquid from the floor surface to leave the floor in a substantially dry state. A tank is mounted on the housing for collecting the contaminated liquid that has been removed from the surface by operation of the suction motor, and a power source provides electrical power to the suction system.

U.S. Pat. No. 6,370,731 to Carter relates to a dusting attachment for a vacuum. The attachment includes a core unit with base and apex ends and three lengthwise oriented portions. The core is provided with a selected functional patterning of air apertures that extend through the core's outboard and inboard surfacing and communicate with the core's central air channel. A feathering system is attached to the interstitial spaces of the core's outboard surfacing.

U.S. Pat. No. 6,746,166 to Jeon et al. discloses an apparatus for cleaning stains and extracting cleaning fluid from a surface without requiring electrical power. A sprayer receives fluid from an attached refillable reservoir of cleaning solution. During scrubbing, the top of a pump actuator provides a resting place for the heel of a user's palm. The pump actuator may be locked down when scrubbing and unlocked for pumping to suck up fluid. A piston in a chamber provides the suction force for pulling fluid up through tubules, which may be interspersed between bristle tufts, past check valves and into a waste reservoir.

U.S. Pat. No. 6,799,350 to Gordon discloses a suction-assisted dust mop. An electric motor powered blower or fan is connected to a hollow tube to generate a suction for cleaning dust at multiple suction holes in the tube walls, which in turn generates suction in the fiber pile of the dust mop covering the suction holes. Chemical agents and/or an electrostatically charged fiber pile are disclosed along with suction to improve the efficiency of the dust cleaning process.

U.S. Pat. No. 6,921,438 to Lausevic relates to a vacuum cleaner attachment for fungi removal. The attachment includes an abrasive and porous pad for dislodging fungus. The debris and particulate matter generated by the abrasive process is drawn into the vacuum attachment and into the vacuum system.

U.S. Patent Publication No. 2005/0015919 to Stewart discloses an automatic dustpan broom. The broom includes an aspiration canal in the broom brush, reaching an aspiration tubing situated inside the broom handle. A motor is situated alongside the tubing and permits the aspiration of air through the aspiration canal and aspiration tubing by an opening along the tubing side. The opening is made of a semi permeable membrane which allows air to exit the tube while keeping dust inside.

U.S. Patent Publication No. 2004/0025271 to Shimada et al. relates to a cleaning device that includes a cleaning surface, a support arm, handle portion, and a pivot for pivotally supporting the support arm. The cleaning surface includes an adhesive surface and a cleaning cloth surface.

U.S. Patent Publication No. 2004/0148732 to Allard-Latour et al. discloses an end piece for a vacuum cleaner. The end piece includes a plate having a lower surface which rests on the ground and includes channels which direct suctioned air to a suction opening. The lower surface of the plate includes three suction channels between which a wiping device is mounted. The wiping device is not specifically defined; however, it is noted that the wipe may be damp, or dampened with a liquid conveyed to the wipe from a reservoir built into the nozzle.

U.S. Patent Publication No. 2004/0221419 to Franceoeur discloses a vacuum cleaner nozzle. The nozzle includes a body having a cleaning surface defining a first and second cleaning section. The first and second cleaning sections are provided with first and second dislodging bristles for dislodging the soiled particles from the soiled surface.

U.S. Patent Publication No. 2006/0048331 to Stewart relates to a floor cleaning machine having a microfiber pad. A microfiber cleaning assembly is mounted beneath the machine for cleaning the floor following the vacuum pick-up.

U.S. patent application Ser. No. 11/090,438 filed Mar. 25, 2005 discloses a soft surface remediation device. In one embodiment, the device includes a dust filter and may be attached to a vacuum for cleaning upholstery or touch up cleaning.

U.S. patent application Ser. No. 11/373,931 filed Mar. 13, 2006 discloses a duster that may be attachable to a vacuum.

While satisfactory in some regards, the aforementioned devices are not without certain shortcomings and limitations for certain tasks. For example, such previous designs can be relatively complex technologically, expensive, and/or can prove cumbersome to use, especially for extended periods of time.

Accordingly, there still exists a need for a small vacuum utilizing duster adapted for single handed use, which can be used for relatively long periods of time without proving unwieldy and/or without overly fatiguing the user. Furthermore, a need exists for a small vacuum utilizing duster that can be used with conventional dusting cloths while assisting or enhancing the performance of such dusting cloths.

SUMMARY OF THE INVENTION

According to the invention, handheld dust removal devices that selectively utilize vacuum pressure are disclosed. Preferably each device includes a small lightweight handle that houses a vacuum assembly having an electric motor and a battery. The device further includes a duster assembly for removably holding a dusting cloth or cover, whereby it can be used similarly to a conventional duster. The vacuum source can be fluidly connected to and draw a vacuum airflow through the duster assembly, for example, through and/or around the dusting cloth. In some implementations, this is done by drawing the vacuum airflow toward opposing lateral portions of the duster assembly. Some implementations further include an auxiliary vacuum inlet that is adapted and configured for drawing large particles such as crumbs, hair, and others thereinto. The auxiliary vacuum port can be displaced from the duster assembly, e.g., mounted to the handle or elsewhere, as desired.

According to a first aspect of the invention, a vacuum utilizing handheld duster is provided having a handle portion adapted for single handed operation by a user and an elongate duster assembly extending from the handle portion. The handle and duster assembly can intersect each other at a non-straight angle. The duster assembly has first and second lateral segments that define a width dimension therebetween. A vacuum assembly draws an airflow through the duster assembly, toward the first and second lateral segments, creating a non-uniform airflow pattern across the width dimension of the duster assembly. Correspondingly, a first volume of air flows toward the first lateral segment and a second volume of air flows toward the second lateral segment. As such, relatively more air flows toward the perimeter of the duster assembly than toward a longitudinally extending medial portion of the bottom surface of the duster assembly.

In some implementations, the duster assembly removably holds a dusting cloth, preferably a conventional dusting cloth. The vacuum source can draw a vacuum airflow through or around the perimeter of the dusting cloth. This relatively improves the dust retention or other performance characteristics of the dusting cloth.

In some implementations, the vacuum utilizing handheld duster includes a shroud, preferably a flexible shroud, overlying a portion of the duster assembly and also the dusting cloth.

In yet other implementations, the handle, or other portions of the vacuum utilizing handheld duster, has an auxiliary vacuum inlet. The vacuum inlet can accommodate the vacuum removal of relatively large particles, for example, crumbs, hair, and/or other debris.

As desired, the duster assembly can be removably attached to the handle. In these embodiments, the vacuum inlet can be provided at the end of the handle that removably connects to the duster assembly. In this configuration, the user removes the duster assembly from the handle to access the vacuum inlet for removing large particles from a surface. Optionally, the vacuum inlet can be provided at the end that is most distal the duster assembly.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which:

FIG. 7 is a perspective view of a third embodiment of a vacuum utilizing handheld duster;

FIG. 8 is a perspective view of the upper surface of the bottom section of a shroud of FIG. 7;

FIG. 9 is a perspective view of the bottom surface of the top section of the shroud of FIG. 7;

Figure 1:
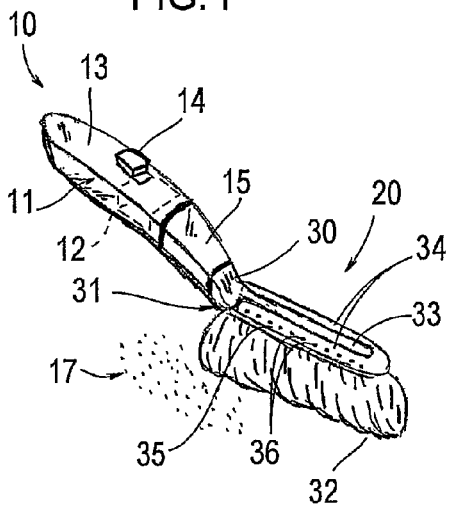
FIG. 1 is a perspective view of a first embodiment of a vacuum utilizing handheld duster of the invention.

In describing the preferred embodiment of the invention that is illustrated in the drawings, specific terminology will be resorted to for the sake of clarity. However, it is not intended that the invention be limited to the specific terms so selected and it is to be understood that each specific term includes all technical equivalents, which operate in a similar manner to accomplish a similar purpose. For example, the word "connected", "attached", or terms similar thereto are often used. They are not limited to direct connection but include connection through other elements where such connection is recognized as being equivalent by those skilled in the art.

DETAILED DESCRIPTION OF THE INVENTION

Specific embodiments of the present invention will now be further described by the following, non-limiting examples which will serve to illustrate various features of significance. The examples are intended merely to facilitate an understanding of ways in which the present invention may be practiced and to further enable those of skill in the art to practice the present invention. Accordingly, the examples should not be construed as limiting the scope of the present invention.

1. System Overview

In a basic form, the invention is a cleaning and/or dusting tool that employs certain features of a vacuum cleaner, e.g., the invention embodies a vacuum utilizing handheld duster. The vacuum utilizing handheld duster includes a vacuum source which can pull or draw suction through or around a disposable dusting cloth. In some implementations, the vacuum source draws suction at the edges of the dusting cloth, about the perimeter of the cloth, through a hollow arm, through an inlet separate from the dusting cloth, and/or otherwise into the device.

The vacuum utilizing handheld duster is small, lightweight and easy to maneuver. It is adapted for single-handed operation and can be used for extended periods without user fatigue or discomfort. For example, the vacuum utilizing handheld duster can be continuously used for time periods that are generally of the same duration as required for typical household dusting tasks.

The vacuum utilizing handheld duster increases the effectiveness, and thereby provides an enhanced cleaning ability, of commercially available, disposable dusting cloths. In other words, when a commercially available, disposable dusting cloth is used with the vacuum utilizing handheld duster, it traps, attracts, and holds more dust than the ordinary dusting cloth would alone. The cloth itself provides typical the functionality associated with contact-type surface dust removal. This functionality is complemented and enhanced by the vacuum airflow that tends to entrain dust particles therein, drawing them into the vacuum utilizing handheld duster. By drawing a vacuum through and/or around the cloth, an airflow is established flowing into the vacuum utilizing handheld duster that can (i) draw or intake dust particles from the surface being cleaned, and/or (ii) draw or intake low-hovering or floating airborne dust particles suspended above the surface being cleaned.

Furthermore, the vacuum utilizing handheld duster further provides an auxiliary vacuum inlet and collection chamber to hold larger debris such as crumbs, pet hairs, and/or other hairs. In such implementations, the vacuum utilizing handheld duster has enhanced dust particle removing capabilities as well as the integrated capability of removing relatively large particles from surfaces as desired. This eliminates the need for a dustpan and brush, or separate vacuum cleaner.

2. Detailed Description of Preferred Embodiments

Specific embodiments of the present invention will now be further described by the following, non-limiting examples which will serve to illustrate various features of significance. The examples are intended merely to facilitate an understanding of ways in which the present invention may be practiced and to further enable those of skill in the art to practice the present invention. Accordingly, the below examples should not be construed as limiting the scope of the present invention.

Figure 2:
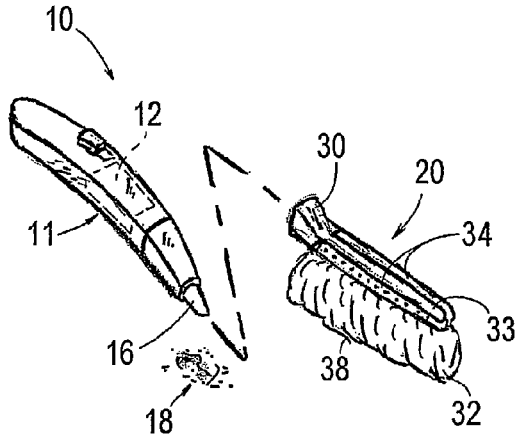
FIG. 2 is a perspective, exploded view of the vacuum utilizing handheld duster of FIG. 1 with a handle portion separated from a duster assembly.

Turning initially to FIGS. 1 and 2, the inventive cleaning or dusting tool, e.g., vacuum utilizing handheld duster 10, is illustrated according to one embodiment of the present invention. In this embodiment, vacuum utilizing handheld duster 10 includes a handle portion 11 slidably received into or otherwise connected to a duster assembly 20. The duster assembly 20, in turn, holds a cleaning cloth or pad, e.g., dusting cloth 32.

Handle portion 11 houses a vacuum source 12 therein. The vacuum source 12 includes an electric vacuum motor and a corresponding power supply, e.g., one or more batteries, preferably, rechargeable batteries. Optionally, the vacuum utilizing handheld duster 10 includes a suitable power converter, whereby it may include a 120VAC cord for powering the vacuum utilizing handheld duster 10 or for charging the batteries. As desired, the vacuum utilizing handheld duster 10 may be designed to sit within a charging cradle (not shown).

On/off switch 14 provides a user interface for selectively energizing the vacuum source 12. When the vacuum source 12 is energized, the vacuum motor creates a vacuum pressure or suction that establishes a flow of air into the handle, typically after traversing through other portions or components of the vacuum utilizing handheld duster 10, explained in greater detail elsewhere herein. Vacuum source 12 draws a vacuum through a vacuum inlet 16, which opens through the handle portion 11. Vacuum inlet 16 can be, for example, on an end of handle portion 11 that intersects the remainder of the vacuum utilizing handheld duster 10 (FIG. 2), or elsewhere as desired.

Handle portion 11 also includes a handle grip 13 that is preferably a curved ergonomically designed member configured to comfortably fit within the palm of a hand of a user. The handle grip 13 may be constructed in a wide variety of sizes depending on the intended use while allowing for ease of use, manipulation, packaging, shipping, and storage of the vacuum utilizing handheld duster 10 as well as increasing the overall ergonomics of the design. Preferably, the handle grip 13 is sized, adapted, and configured for single handed operation by the user, enabling the user to comfortably operate the vacuum utilizing handheld duster 10 for extended periods of time, while mitigating discomfort or fatigue. Thus, the handle grip 13, at least in combination with the overall mass of vacuum utilizing handheld duster 10, enables a user to continuously perform typical household dusting tasks.

Furthermore, the length of the handle portion 11 and/or handle grip 13, as compared to the overall length of vacuum utilizing handheld duster 11, and/or the placement of the center of mass of the vacuum utilizing handheld duster 10, is selected to provide suitable comfort to the user during extended use periods. The handle portion 11 is preferably less than about ⅔ of the overall length, optionally less than about ½ the overall length, of the vacuum utilizing handheld duster 10, so that the handle portion or handle grip 13 do not prove unwieldy during use. Preferably, the center of mass of the vacuum utilizing handheld duster 10 is located near the handle grip 13 to mitigate the non-desired lever arm force multiplication associated with placing a large portion of the device mass at its terminus, i.e., displaced from the user's hand.

Handle grip 13 may be constructed from a variety of synthetic resins, plastics, or other suitable materials such as polypropylene, as well as various resilient elastomeric materials. As desired, handle grip 13 or other parts of handle portion 11 may be constructed in a variety of colors for increased aesthetic appeal.

In some implementations, the handle portion 11 includes an enclosure, such as collection box 15, that is adapted to collect and hold the various particles that the vacuum utilizing handheld duster 10 intakes during use. As desired, the collection box 15 may be constructed from a translucent material so that the amount of debris that has been picked up and accumulated in collection box 15 is visually conspicuous to the user.

Collection box 15 can include one or more outlet vent 17 which vent off any positive pressure that would tend to accumulate in the collection box 15. Optionally, the outlet vent(s) 17 can be located elsewhere on handle portion 11, but in any regard are adapted and configured to fluidly communicate with vacuum source 12. For example, vents 17 can be provided adjacent, e.g., an output side of the vacuum motor, to mitigate the likelihood of non-desired positive pressure buildup within the vacuum utilizing handheld duster 10.

Figure 3:
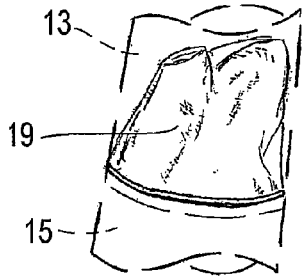
FIG. 3 is a perspective view of an internal filter used in the vacuum utilizing handheld duster of FIG. 1.

Referring now to FIG. 3, a filter assembly 19 can be provided to capture small particulate matter, such as dust 17. In other words, the filter assembly 19 holds various particles that are not retained in the collection box 15. The filter assembly 19 can be located between the collection box 15 and the vacuum source 12. In other embodiments, the filter assembly 19 is provided between the handle portion 11 and the duster assembly 20, or elsewhere depending on the particular configuration of the vacuum utilizing handheld duster 10.

The handle portion 11 can angularly intersect the duster assembly 20, at a non-straight angle, such that during use, the handle portion 11 and the duster assembly 20 are generally non-coplanar. In such implementations, the handle portion 11 and the duster assembly 20 are provided at different relative heights with respect to a working surface from which dust is removed.

Referring again to FIGS. 1 and 2, duster assembly 20 includes a cylindrical piece or collar 30, a hollow support head 31, and a retaining prong 33. Collar 30 is sized, adapted, and configured to removably attach duster assembly 20 to the handle portion 11. As seen in FIG. 2, collar 30 can concentrically receive and house the vacuum inlet 16 therein. Furthermore, collar 30 is hollow and functions as an air-passage connecting the vacuum source 12, by way of vacuum inlet 16 or otherwise, to the support head 31.

Support head 31 includes lateral segments 34 which generally define a width dimension therebetween. Correspondingly, a longitudinally extending medial portion of the support head 31 is located between, or laterally flanked by, the lateral segments 34. In some embodiments, support head 31 has a single, unitary hollow body extending between the lateral segments 34, whilst in other embodiments the lateral segments 34 are distinct hollow members, transversely separated from each other.

In any regard, the hollow void space(s) of support head 31, and thus the duster assembly 20, is fluidly connected to the vacuum source 12. Preferably, multiple openings 36 extend through various sidewall(s) or other structures of the support head 31 or other portions of the duster assembly 20. The openings 36 extend into the void space within the duster assembly 20, whereby the openings 36 function as inlets which provide the suction or vacuum airflow entrance into the support head 31.

Still referring to FIGS. 1 and 2, the openings 36 can be primarily provided at or adjacent the lateral segments 34 of the support head 31, optionally elsewhere in the duster assembly 20, as desired. With the openings 36 primarily at, adjacent, or otherwise proximate lateral segments 34, the vacuum is generally drawn through, e.g., outer portions of the support head 31, which creates a non-uniform airflow pattern across the width dimension of the duster assembly, having greater flow rates near the lateral segments 34.

In other words, a first volume of air flows toward a first lateral segment 34 and a second volume of air flows toward a second lateral segment 34, such that relatively more air flows upwardly toward the perimeter of the duster assembly 20 than the remainder of the vacuum utilizing handheld duster 10. Correspondingly, the placement of the openings 36 can intake the airflow(s) adjacent the lateral segments 34, urging airflow away from the longitudinally extending medial portion of the support head 31. This can help draw more dust into the vacuum utilizing handheld duster 10 for capture by the filter 19, extending the use-life of the dusting cloth 32.

Dusting cloth 32 includes a sleeve 35 that is configured to slide over the support head 31 and relatively loose strands 38 (FIG. 2) for trapping and retaining dust particles 17. Sleeve 35 may be constructed from an elastomeric material to snuggly fit over the support head 31. Sleeve 35 can have two open ends to allow the dusting cloth 32 to be reversible and insertable on the support head 31 from either end. The reversibility of the dusting cloth 32 by way of sleeve 35 allows for maximum use of the dusting cloth 32. For embodiments of dusting cloth 32 that are devoid of sleeves 35, other structures can be used to secure the dusting cloth 32 to the support head 31, such as, e.g., Velcro®, rubber bands, fabric ties, and/or other temporary retaining structures and devices.

The cloth 32 can be formed by any suitable material or material-forming process known, including woven and nonwoven materials, polymers, gels, extruded materials, laminates, layered materials which are bonded together integrally and thus form a co-material, fused materials, extruded materials, air laying, etc.

The particular configuration of dusting cloth 32 is selected bases on the intended end use environment. Accordingly, dusting cloth 32 is any of a variety of suitable cloths or pads made from various natural fibers, such as cotton and/or others, synthetic, polymeric based fibers. The cloths or pads used as dusting cloth 32 can be formed from any material(s) or material-forming process known, including woven and nonwoven materials, polymers, gels, extruded materials, laminates, layered materials which are bonded together integrally and thus form a co-material, fused materials, extruded materials, air laying, etc.

Thus, the dusting cloth 32 may, for example, include a plurality of fluffed nonwoven fabrics made of synthetic resins, which may be welded to one another. The cloth may include fibers constructed from PP, PE, PET fibers in a variety of alternative percentages by weight. As desired, the dusting cloth 32 can be, e.g., a 20 g/sqm spun lace cloth with between 1-4% mineral oil manufactured by Haso Corporation of Japan. Examples of such cleaning or dusting pads are described in PCT/JP2004/010507, incorporated herein.

When absorbing functionality is desired, the dusting cloth 32 can include various polymeric components that allow for the spontaneous transport of aqueous fluids. Such polymers are described in, for example, U.S. Pat. Nos. 5,723,159; 5,972,505; and 5,200,248, all of which are incorporated by reference. The absorbent materials may also take the form of known super absorbent polymers ("SAPs"). The SAPs may be, for example, acrylic based polymers applied as a coating or turned into fibers directly. Such commercially available SAPs generally include X-linked polyacrylic acids or X-linked starch-acrylic-acid-graft-polymers, the carboxyl groups of which are partially neutralized with sodium hydroxide or caustic potash. The SAPs may be made by such processes as a solvent or solution polymerization method or the inverse suspension or emulsion polymerization method. Such SAPs are disclosed in, for example, U.S. Pat. No. 6,124,391, incorporated by reference herein.

Yet other cloths and pads suitable for use as cloth 32 are further described in, e.g., U.S. patent application Ser. No. 11/124,527 filed May 6, 2005 and incorporated herein by reference, U.S. patent application Ser. No. 11/373,931 filed Mar. 13, 2006 and incorporated herein by reference, U.S. patent application Ser. No. 11/334,855 filed Jan. 19, 2006 and incorporated herein by reference, and U.S. patent application Ser. No. 11/550,675 filed Oct. 18, 2006 and incorporated herein by reference.

Regardless of the particular fiber type(s) implemented, the dusting cloth 32 can be comprised from a single cloth or pad or from multiple cloths or pads attached sequentially to cover the support head 31. Thus, as desired, the dusting cloth 32 includes a 360-degree configuration, whereby a generally uniform cleaning surface is defined circumferentially about a longitudinal axis of the support head 31.

Retaining prong 33 can extend longitudinally from the collar 30, in the same direction as the support head 31, and resides above, e.g., the longitudinally extending medial portion of the support head 31. Namely, the retaining prong 33 lies over an upper surface of the support head 31, the retaining prong 33 and the support head 31 defining a clearance therebetween. This clearance between the retaining prong 33 and the support head 31 accepts the sleeve 35 of dusting cloth 32 therein. To removably mount the dusting cloth 32 to the duster assembly 20, a user slides the sleeve 35 over the support head 31, and between the upper surface of the support head 31 and the lower surface of the prong 33. Accordingly, the prong 33 resiliently clamps down upon the sleeve, securing the dusting cloth 32 to the support head 31.

Therefore, in the complete assemblage of the vacuum utilizing handheld duster 10, by drawing a vacuum through openings 36, a vacuum and airflow are correspondingly established through, around, or near the sleeve 35, strands 38, or other portions of dusting cloth 32 depending on the particular placement of openings 36 in relation to the dusting cloth 32. By drawing a vacuum, e.g., through the dusting cloth 32, its dust retention, affinity for dust, and/or other dust capturing or performance characteristics are improved or otherwise influenced.

Accordingly, in a typical cleaning operation, the small size and light weight make the vacuum utilizing handheld duster easy to hold and maneuver with a single hand, enabling the user to operate it for extended periods without user fatigue or discomfort. In using the vacuum utilizing handheld duster 10, the user places the desired dusting cloth 32 over the support head 31 and under the retaining prong 33. The vacuum source 12 is energized via the on/off switch 14 and the vacuum utilizing handheld duster 10 is used like a standard dry duster.

With the vacuum source 12 energized, the dusting cloth 32 wipes across the surface being cleaned or dusted, and has enhanced performance characteristics as compared to the cloth 32 alone without vacuum assistance. The performance of dusting cloth 32 is supplemented, assisted, and/or otherwise enhanced by the vacuum airflow that tends to entrain dust particles therein, drawing them into the vacuum utilizing handheld duster 10. Namely, the vacuum source 12 pulls air, i.e., creates vacuum pressure or suction, through or around the disposable dusting cloth 32 via the openings 36 in the hollow support head 31. By drawing a vacuum through or around the cloth, an airflow is established that flows into the vacuum utilizing handheld duster 10.

Correspondingly, the vacuum airflow can entrain dust particles that are upon or floating above the surface being dusted and improve retention of dust particles on the dusting cloth 32. This is because the vacuum pressure provides a force in opposition to, e.g., gravitational, electrostatic, and/or other forces which tend to urge the dust particles 17 away from the fiber strands 38 of the dusting cloth 32.

Accordingly, the generated suction from vacuum source 12 contributes to trapping, and retaining, relatively more dust particles 17 on the disposable dusting cloth 32, as compared to a standard dry duster. Furthermore, the vacuum airflow can draw particles from the dusting cloth 32 into the vacuum utilizing handheld duster 10. In any event, vacuum source 12 improves the cleaning and dusting effectiveness of the disposable dusting cloth 32.

Thence, upon encountering larger debris 18 such as crumbs, dirt, or pet hair, the duster assembly 20 can be removed from the handle portion 11 and the debris 18 sucked up through the vacuum inlet 16. The debris 18 is then stored in the collection box 15 which can be removed and emptied when full or after cleaning or otherwise as desired, thereby eliminating the need for a dustpan and brush, or separate vacuum cleaner.

Figure 4:
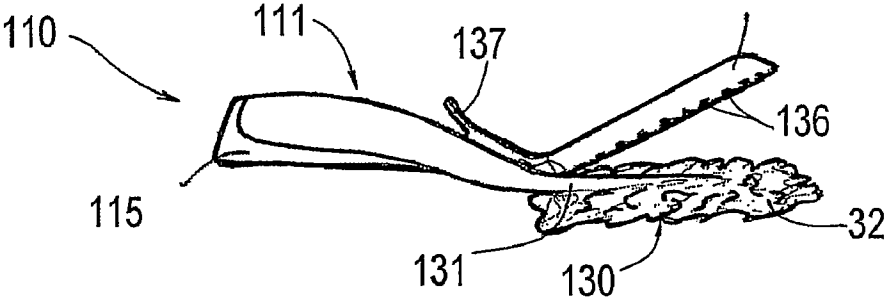
FIG. 4 is a side view of a second embodiment of a vacuum utilizing handheld duster with its shroud in a lifted position.
Figure 5:
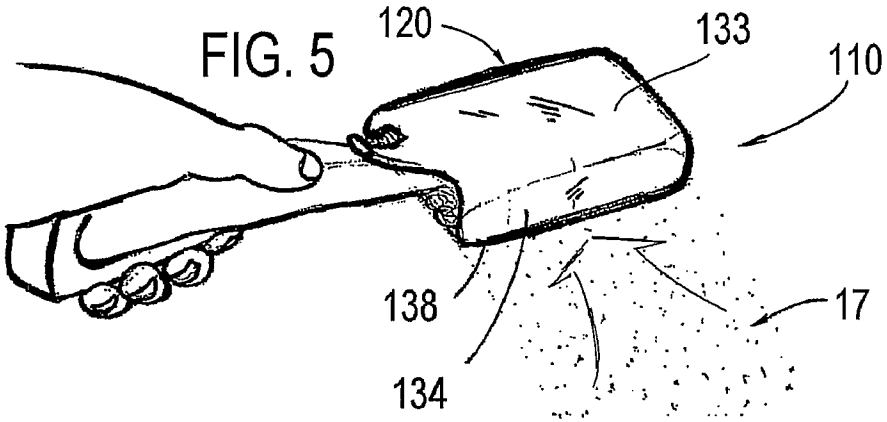
FIG. 5 is a perspective view of the vacuum utilizing handheld duster of FIG. 4 showing the cleaning device in operation.
Figure 6:
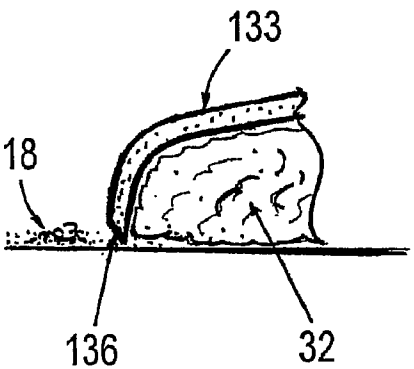
FIG. 6 is a close-up perspective view of the vacuum utilizing handheld duster of FIG. 4 showing the suction provided at an edge of the shroud.
Figure 10:
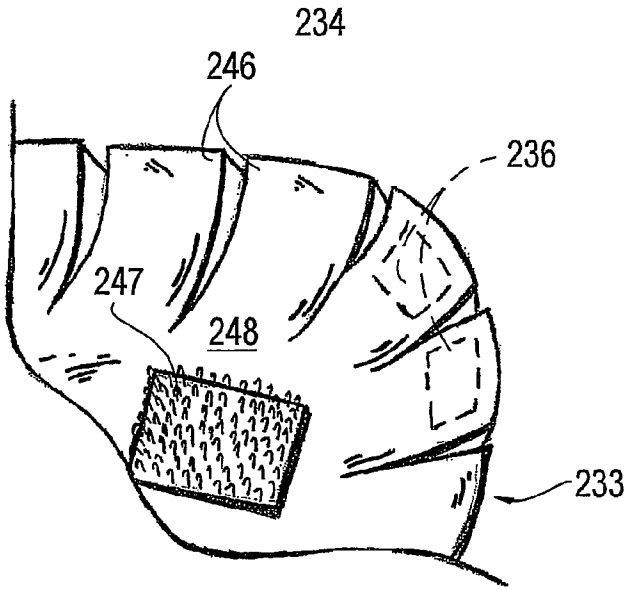
FIG. 10 is a close-up lower perspective view of the bottom section of the shroud of FIG. 7.
Figure 11:
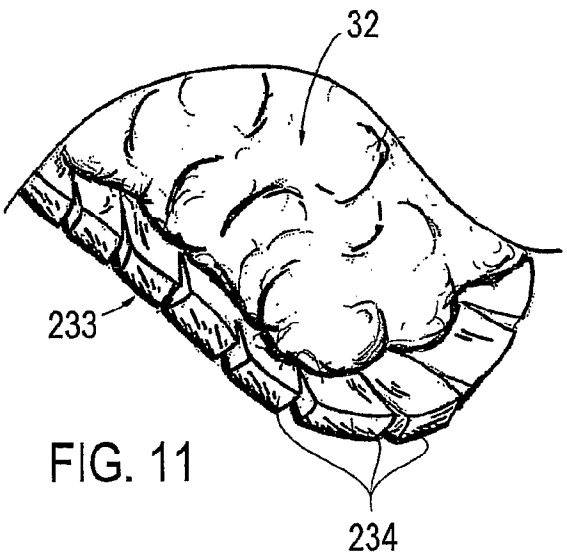
FIG. 11 is a close-up lower perspective view of the bottom section of the shroud of FIG. 7 with a cleaning cloth attached.

Referring now to FIGS. 4-6, in some embodiments, vacuum utilizing handheld duster 110 includes a handle portion 111 that is integrally connected to the dusting assembly 120. The disposable cleaning cloth 32 is inserted onto the support head 131 via a sleeve 35 in the cloth 32. The cloth 32 is further retained onto the support head 131 by a hollow elastomeric shroud 133 that flexes over the cloth 32.

In particular, shroud 133 has a generally planar upper wall segment that overlies an upper portion of cloth 32. Opposing lateral sides 134 extend downwardly from the lateral edges of the shroud 133 upper wall segment. Preferably, cloth 32 and shroud 133 are correspondingly sized so that the sides 134 laterally retain the cloth 32 therebetween.

Shroud 133 can be hollow or otherwise adapted for passing airflow therethrough. In such embodiments, the sides 134 include multiple openings 136 that extend through the lowermost edges 138 of the sides. Furthermore, the hollow portion of shroud 133 is connected to vacuum source 12, whereby the vacuum source 112 draws an airflow through the openings 136 and through the shroud 133.

A lever 137 pivotably attaches the shroud 133 to the handle portion. In the resting position, the shroud 133 holds or squeezes the cloth against the support head 131. Accordingly, to replace the cloth 32, the user depresses the lever 137 which pivotably lifts the shroud 133 away from the support head 131 and the cloth 32. In other words, the lever 137 is provided to lift and lower the shroud 133 which permits access to the cloths 32 for removing and replacing.

In light of the configuration of shroud 133, when the vacuum source 12 is energized, suction is created and air flows through the openings 136, along the bottom edges 138 of the sides 134 of shroud 133. As desired, the openings 136 can be large enough so that dust particles 17 as well as larger debris 18 can be drawn therethrough, and deposited in a debris collection box 115. It should be noted that the openings/sides in contact with the surface may be situated around the entire perimeter of the duster to maximize suction. Remaining dust particles 17 and larger debris 18 that are not sucked up by the openings 136 in the shroud 133 become entrapped in the disposable cleaning cloth 32.

Referring now to FIGS. 7-11, vacuum utilizing handheld duster 210 includes a handle portion 211 with a handle grip 213, on/off switch 214, collection box 215 and outlet vents 217. An internal filter, vacuum source and batteries, preferably rechargeable, are not shown but are located preferably in the handle portion 211.

Some implementations of vacuum utilizing handheld duster 210 of FIGS. 7-11 are similar in operation and design to those of vacuum utilizing handheld duster 110 of FIGS. 4-5, in that they incorporate a flexible and generally hollow cover 233 overlying the upper portion of cloth 32. However, hollow cover 233 of FIGS. 7-11 can further include multiple flexible fingers 234 extending from its perimeter. The fingers 234 are sufficiently flexible to enable them to individually flex about and thus conform to surfaces and squeeze into tight spots.

In some implementations, the hollow void space of shroud 233 is defined between multiple individual components that are attached to each other to arrive at the subassembly of shroud 233. For example, shroud 233 can include a bottom section, or piece, 241 and a top section, or piece, 244. The top and bottom sections 241, 244 are preferably cut out of foam and joined, adhered, or otherwise connected or attached together. Supports 242 are incorporated to improve the overall rigidity of the shroud 233. Accordingly, supports 244 help preserve the structural integrity of the shroud 233 during use. Moreover, the supports 244 also at least partially define a conduit through which the vacuum airflow passes.

It is contemplated that the fingers 234 can include openings 236 and air guides 243, preferably formed in the bottom section 241 thereof. The openings 236 and air guides 243 direct dust and debris into the assembled shroud 233. Such dust and debris is thence drawn though the shroud 233 and, e.g., into collection box 215. As desired, flaps 246 can selectively and resiliently cover the openings 236. Preferably, the flaps 246 are coated in a silicone rubber to provide a high friction interface between the flaps 246 and the surface that they drag across.

When flaps 246 are not in contact with a surface and the vacuum source is energized, the vacuum pressure urges flaps 246 against the fingers 234. As such, the flaps 246 close, restricting airflow through the openings 236. When the fingers 234 are in contact with and move across a surface, friction between the surface and the flaps 246 causes the flaps 246 to move, pulling them away from the remainder of the fingers 234. This permits air to be drawn through the openings 236.

Accordingly, in the embodiments of FIGS. 7-11, during use and movement of the vacuum utilizing handheld duster 210, only the flaps 246 on the leading edge of the shroud 233 will open, while all other or trailing flaps 246 remain closed. This means that air is preferentially drawn into the shroud 233 on the leading edge. By preferentially drawing air into the shroud 233 through only a subset of the openings 236, the power requirements of the vacuum device can be minimized. It is noted that the openings 236 must be small enough to ensure that the flaps 246 are not sucked into the shroud 233 when the vacuum motor is turned on. Preferably, two hook and loop fasteners or attachment pieces, e.g., from Velcro® or other brands, 247 are attached to the outside surface 248 of the bottom section 241. The hook and loop fasteners 247 enable quick, removable attachment of the disposable cleaning cloth 32 to the shroud 233.

Shroud 233 can be made from any of a variety of suitably resilient or otherwise flexible materials. However, speed of construction of the shroud 233 and the choice of materials can be greatly improved by creating a mold to form the bottom and top shroud pieces 241, 244. For example, compression molding has proven a suitable technique for making shroud 233. Compression molding typically allows a larger number of shrouds 233 to be rapidly created, including testing the impact of a wider range of foams on the overall flexibility. Flexibility may be modified by the process of laminating the different foam sections together as the resulting composite structure is relatively rigid. Using flexible adhesives, e.g., cyanoacrylate has been used also. Heat welding could be used for joining the two sections 241, 244 together.

Figure 12:
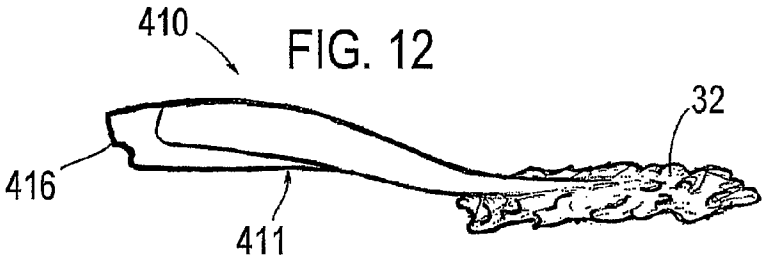
FIG. 12 is a side elevational view of a fourth embodiment of an assembled vacuum utilizing handheld duster.
Figure 13:
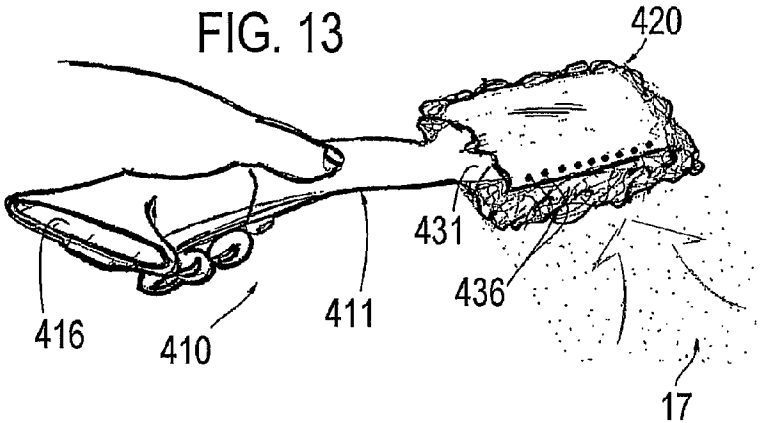
FIG. 13 is a perspective view of the vacuum utilizing handheld duster of FIG. 12 in a first use operation.
Figure 14:
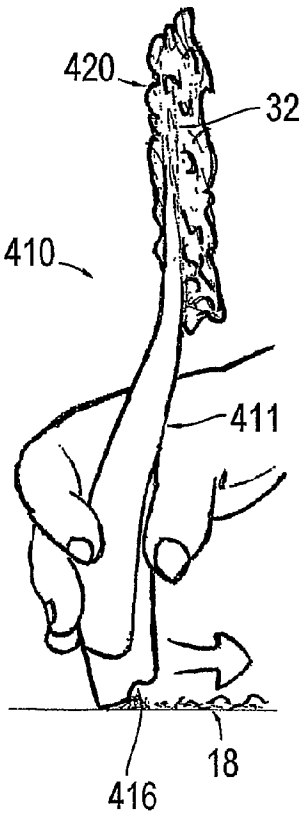
FIG. 14 is a side elevational view of the vacuum utilizing handheld duster of FIG. 12 in a second use operation.

FIGS. 12-14 show yet other embodiments of a vacuum utilizing handheld duster 410. In some such embodiments, as desired, there can be generally little or no suction through the cleaning cloth 32 or the duster assembly 420. Instead, a vacuum inlet 416 is provided at the base of handle portion 411. As with the other embodiments, a vacuum source and batteries are preferably located in the mid-section of the handle portion 411. Optionally, referring now to FIG. 13, support head 431 of duster assembly 420 can have openings 436 that are fluidly connected to the vacuum source. Vacuum airflow is drawn through the openings 436 and through and/or around the dusting cloth 32, enhancing its performance characteristics.

As shown in FIGS. 13 and 14, the vacuum utilizing handheld duster 410 is used in a horizontal position to entrap dust particles 17 in the cloth 32, in a substantially conventional manner. Thence, the vacuum utilizing handheld duster 410 can be rotated 90° to a vertical position to vacuum up heavy dust and/or larger particles or debris 18 through the vacuum inlet 416. The cleaning cloth 32 can be secured to the vacuum utilizing handheld duster 410 with a pronged or forked support head 431, such as that disclosed in co-pending U.S. patent application Ser. No. 11/373,931 filed Mar. 13, 2006 entitled "Improved Cleaning or Dusting Pad", the entirety of which is herein incorporated by reference.

Figure 15:
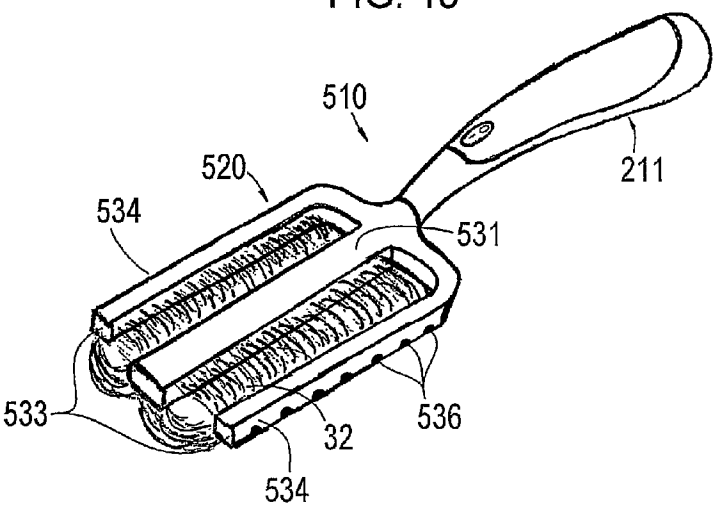
FIG. 15 is a perspective view of a fifth embodiment of vacuum utilizing handheld duster.

FIG. 15 shows a further embodiment of a vacuum utilizing handheld duster 510. This embodiment preferably uses the handle portion 211 of the vacuum utilizing handheld duster 210 of the third embodiment shown in FIG. 7, however, incorporates a different duster assembly 520. Duster assembly 520 incorporates twin arms 533 and a central spine support head 531. The twin arms 533 have openings 536 that are connected to the vacuum motor to create a suction airflow along the two lateral sides 534 of the cleaning cloth 32. The central spine 531 may also have openings similar to openings 536 to draw a suction airflow through the cloth 32.

Figure 16:
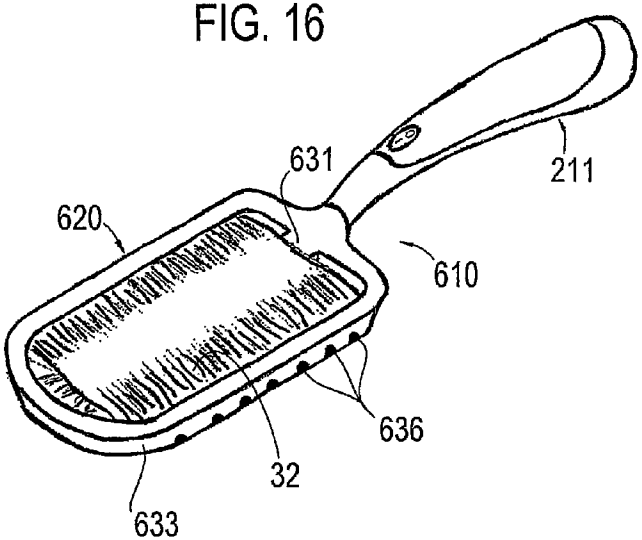
FIG. 16 is a perspective view of a sixth embodiment of a vacuum utilizing handheld duster.

FIG. 16 shows a variant of the embodiment disclosed in FIG. 15. Vacuum utilizing handheld duster 610 is largely the same as the embodiment with the twin arms 533 of FIG. 15, the duster assembly 620 includes a front nose-type segment connecting the lateral segments. In other words, duster assembly 620 includes a single unitary member that extends around the front of the cleaning pad 32 to form a single U-shaped arm 633. The entire arm 633 has openings 636 similar to those on the twin arms 533, connected to the vacuum source, drawing a suction airflow around the perimeter of the cleaning cloth. As desired, the central spine 631 may also have openings to create a suction pulled through the cloth 32.

Figure 17:
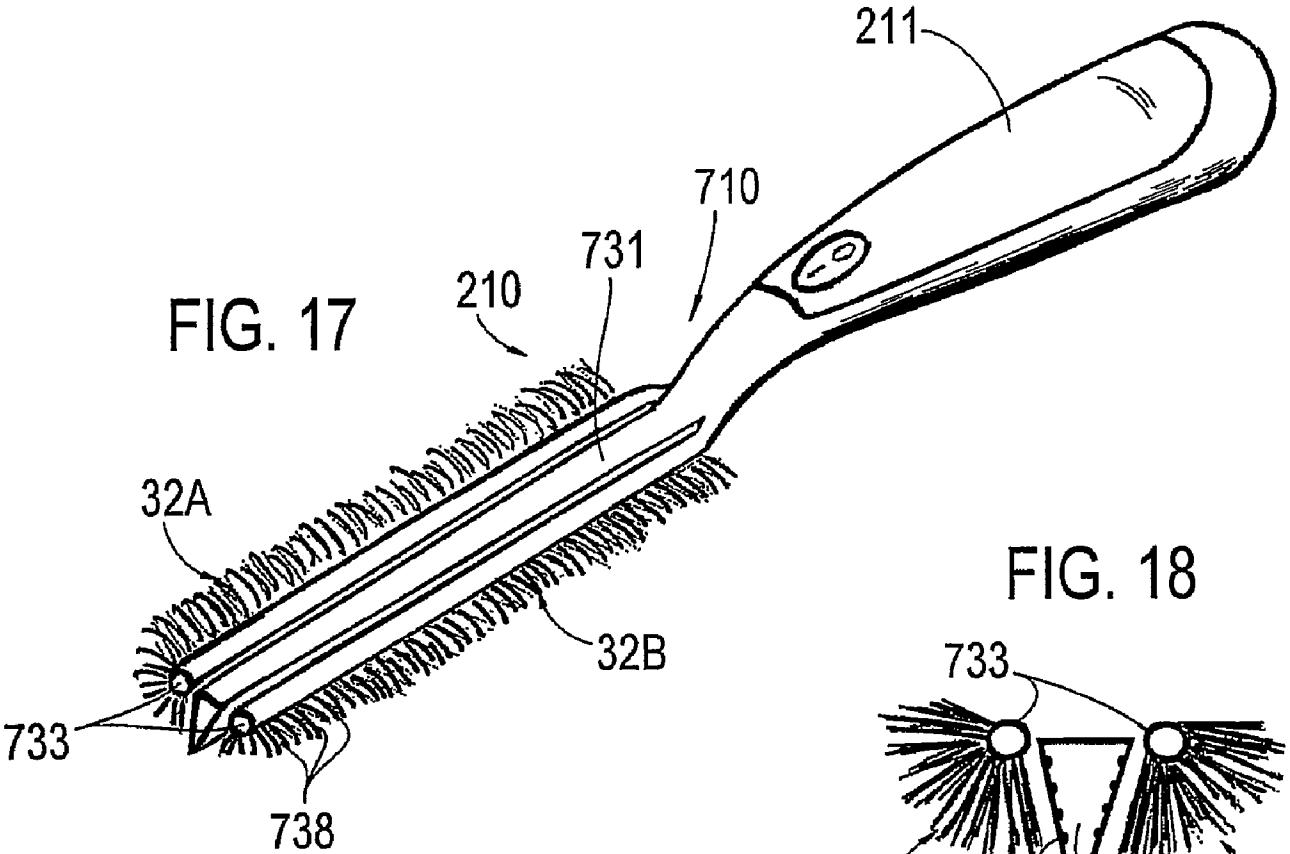
FIG. 17 is a perspective view of a seventh embodiment of a vacuum utilizing handheld duster.
Figure 18:
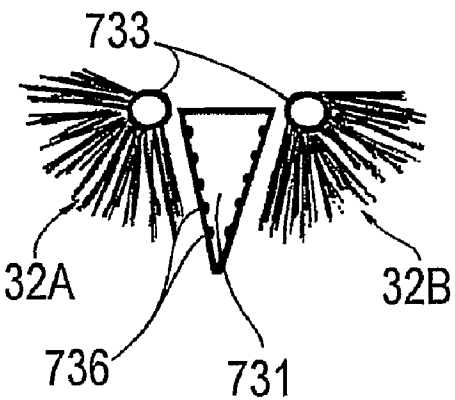
FIG. 18 is a front elevational view the cleaning device of FIG. 17.

FIGS. 17-18 show yet another embodiment of a vacuum utilizing handheld duster 710. This embodiment preferably also uses the handle portion 211 and incorporates a single central spine, e.g., central suction arm 731. The central suction arm 731 contains openings 736 extending along its length which function as vacuum airflow inlets. Arms 733 laterally flank the central suction arm 731 and provide mounting structure for the paired dusting cloths 32A-B. During use, the dusting cloths 32A-B are slid over the arms 733, and the openings 736 draw a vacuum generally through the dusting cloths 32A-B.

By tilting the vacuum utilizing handheld duster 710 from side to side, the central suction arm 731 can be brought into contact with dust on a surface in advance of the cleaning cloths 32A-B. Preferably, the fibers 738 on the cleaning cloths 32A-B are sufficiently short in length to prevent them from being drawn into the suction arm 731 when the vacuum is operating.

In yet other implementations, any of the vacuum utilizing handheld dusters, preferably, incorporated into the respective handle portions, may further include a reservoir filled with cleaning fluid to be sprayed on a surface or on the cleaning cloth 32 such as is described in U.S. patent application Ser. No. 11/045,204 filed Jan. 28, 2005, incorporated herein by reference.

Furthermore, any of the discussed vacuum utilizing handheld dusters may also be sold as part of a kit as is described in U.S. patent application Ser. No. 11/450,839 filed Jun. 9, 2006, incorporated herein by reference. If sold as a kit, the vacuum utilizing handheld duster can be packaged and sold with, e.g., a handle portion 11, 111, 211, or others, cleaning fluid, a duster assembly 20, 120, 220, and replacement cleaning cloths 32. Alternately, the kit would not include the handle portion 11 but would include one or more of the various embodiments of the duster assemblies 20, 120, 220. A consumer could then purchase the desired or additional duster assemblies 20, 120, 220 based on their preference or particular need.

Although the best mode contemplated by the inventors of carrying out the present invention is disclosed above, practice of the present invention is not limited thereto. It will be manifest that various additions, modifications, and rearrangements of the features of the present invention may be made without deviating from the spirit and scope of the underlying inventive concept. Furthermore, all the disclosed features of each disclosed embodiment can be combined with, or substituted for, the disclosed features of every other disclosed embodiment except where such features are mutually exclusive.

What is claimed is:

1. A vacuum utilizing handheld duster, comprising:

a handle portion adapted for single handed operation by a user;

an elongate duster assembly extending from the handle portion and including a support head having a longitudinally extending medial portion lying between a first lateral segment and a second lateral segment, the first and second lateral segments defining a width dimension therebetween;

a dusting cloth attached to the support head and extending continuously across the width dimension of the support head; and a vacuum assembly communicating with and drawing a vacuum through the duster assembly, adjacent the first and second lateral segments, and creating a non-uniform airflow pattern across the width dimension of the duster assembly, wherein a volume of air flows toward one of the first and second lateral segments, urging the volume of air away from flowing toward the longitudinally extending medial portion of the duster assembly.

2. The vacuum utilizing handheld duster of claim 1, wherein a first volume of air flows toward the first lateral segment and a second volume of air flows toward the second lateral segment, and wherein the first and second volumes of air diverge from each other while approaching the first and second lateral segments, respectively.

3. The vacuum utilizing handheld duster of claim 2, wherein the vacuum is drawn through the dusting cloth, increasing a dust retention characteristic of the dusting cloth.

4. The vacuum utilizing handheld duster of claim 2, wherein the vacuum is drawn about a perimeter of the dusting cloth, increasing a dust retention characteristic of the cloth.

5. The vacuum utilizing handheld duster of claim 1, the dusting cloth further comprising a sleeve that slides over the support head during installation.

6. The vacuum utilizing handheld duster of claim 1, wherein the handle portion has a vacuum inlet that accommodates the reception of dust particles and non-dust particles from a surface, the non-dust particles being relatively larger than the dust particles.

7. The vacuum utilizing handheld duster of claim 1, wherein the duster assembly is removably attached to the handle portion.

8. The vacuum utilizing handheld duster of claim 1, wherein the vacuum assembly is housed in the handle portion.

9. The vacuum utilizing handheld duster of claim 8, further comprising an enclosure communicating with the duster assembly for collecting particles drawn into the vacuum utilizing handheld duster.

10. The vacuum utilizing handheld duster of claim 9, wherein enclosure is made of a translucent material such that the collected particles therein are visually conspicuous to the user.

11. A vacuum utilizing handheld duster of claim 1, wherein the handle portion defines less than about ⅔ of the overall length of the vacuum utilizing handheld duster.

12. A vacuum utilizing handheld duster, comprising:

a handle portion extending in a first direction and adapted for single handed operation by a user;

an elongate duster assembly attached to and extending generally in the same direction as the handle portion, the duster assembly defining a lower surface having a perimeter thereof and lateral walls extending upwardly from respective outer portions of the lower surface perimeter;

openings extending through the lateral walls and admitting a vacuum airflow into the duster assembly; and a vacuum source cooperating with the duster assembly and drawing the vacuum airflow through the openings of the lateral walls such that the vacuum source draws the vacuum airflow toward a portion of the perimeter of the duster assembly lower surface.

13. The vacuum utilizing handheld duster of claim 12, wherein the lateral walls define a width dimension therebetween, and during use, an airflow pattern is established that is non-uniform across the width dimension of the duster assembly.

14. The vacuum utilizing handheld duster of claim 13, wherein a first volume of air flows toward a first one of the lateral walls and a second volume of air flows toward a second one of the lateral walls such that relatively less air flows upwardly toward a longitudinally extending medial portion of the duster assembly.

15. The vacuum utilizing handheld duster of claim 12, wherein the duster defines a first lateral segment and a second lateral segment and a width dimension therebetween, the vacuum airflow being drawn through the first and second lateral segments, creating a non-uniform airflow pattern across the width dimension of the duster assembly, and wherein a first volume of air flows toward the first lateral segment and a second volume of air flows toward the second lateral segment, and relatively less air flows upwardly toward a longitudinally extending medial portion of the duster assembly, such that the first and second volumes of air diverge away from each other while advancing toward the first and second lateral segments, respectively.

16. The vacuum utilizing handheld duster of claim 15, wherein elongate arms define the first and second lateral segments, respectively.

* * * * *